US010392033B2

(12) United States Patent
Coseglia et al.

(10) Patent No.: US 10,392,033 B2
(45) Date of Patent: Aug. 27, 2019

(54) RAILWAY TRUCK WITH IMPROVED BEARING ADAPTER

(71) Applicant: Amsted Rail Company, Inc., Chicago, IL (US)

(72) Inventors: John Coseglia, Edwardsville, IL (US); Shawn Peetz, Troy, IL (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 252 days.

(21) Appl. No.: 15/208,200

(22) Filed: Jul. 12, 2016

(65) Prior Publication Data

US 2018/0015935 A1 Jan. 18, 2018

(51) Int. Cl.

| | |
|---|---|
| ***B61F 15/28*** | (2006.01) |
| ***B61F 5/30*** | (2006.01) |
| ***B61F 15/12*** | (2006.01) |

(52) U.S. Cl.

CPC ..... *B61F 15/28* (2013.01); *B61F 5/30* (2013.01); *B61F 5/305* (2013.01); *B61F 15/12* (2013.01)

(58) Field of Classification Search

CPC .. B61F 15/12; B61F 15/28; B61F 5/30; B61F 15/20; B61F 15/00; H01R 12/714; H01R 13/2414; H01R 13/2435

See application file for complete search history.

(56) References Cited

U.S. PATENT DOCUMENTS

| | | | | |
|---|---|---|---|---|
| 3,795,037 | A * | 3/1974 | Luttmer | H01R 12/714 174/541 |
| 5,562,045 | A | 10/1996 | Rudibaugh | |
| 6,350,132 | B1 * | 2/2002 | Glatts, III | H01R 13/2414 29/850 |
| 7,308,855 | B2 | 12/2007 | Auken | |
| 7,387,074 | B2 | 6/2008 | Myers | |
| 7,513,199 | B2 | 4/2009 | Van Auken | |
| 7,966,946 | B1 | 6/2011 | Novak | |
| 8,561,548 | B2 * | 10/2013 | Liu | B61F 5/305 105/218.1 |
| 2010/0199880 | A1 | 8/2010 | East | |
| 2014/0318412 | A1 * | 10/2014 | East | B61F 5/28 105/218.1 |

(Continued)

FOREIGN PATENT DOCUMENTS

CN 104960538 A 10/2015

OTHER PUBLICATIONS

PCT Search Report and Written Opinion, from corresponding PCT Patent Application No. PCT/US2017/040298, dated Sep. 28, 2017, 9 pages.

*Primary Examiner* — Mark T Le

(74) *Attorney, Agent, or Firm* — Amsted Industries Incorporated

(57) ABSTRACT

An elastomeric pad is provided for use in a railway car truck that includes two sideframes and a bolster. Each sideframe has a pedestal opening at each end to receive a bearing adapter assembly. The bearing adapter assembly includes a cast steel bearing adapter that is formed to fit on top of an axle bearing assembly. An elastomeric pad, comprised of a selected hardness elastomer, is fit on top of the bearing adapter. Contact buttons extend from the top surface and bottom surface of the elastomeric pad and are received in openings in the elastomeric pad. A conductor provides an electrical connection between the contact buttons.

13 Claims, 2 Drawing Sheets

(56) References Cited

U.S. PATENT DOCUMENTS

| | | | | |
|---|---|---|---|---|
| 2015/0183442 | A1* | 7/2015 | Gotlund | B61F 5/26<br>105/224.05 |
| 2015/0183444 | A1 | 7/2015 | Gotlund | |

* cited by examiner

RAILWAY TRUCK WITH IMPROVED BEARING ADAPTER

BACKGROUND OF THE INVENTION

In a railway freight car truck, two axles are held in a pair of laterally spaced sideframes, with a bolster extending laterally between and supported on each sideframe. The wheels are press fit on the axles, with the ends of the axles also fitted with a roller bearing assembly. The roller bearing assembly itself is fit into a bearing adapter that is fit into a pedestal jaw opening at the longitudinal end of each sideframe. The ends of the bolsters are themselves supported on spring groups, which are supported on the lower portion of the center openings of the sideframes.

The bearing adapter, which is itself fit on top of the roller bearing assembly, is usually comprised of a unitary cast steel piece. An elastomeric adapter pad is fitted on top of the bearing adapter. The adapter pad itself is usually comprised of an injection molded polymer or a castable polyurethane. The adapter pad usually includes four depending legs, two each of which extend from opposite longitudinal edges of the adapter pad. The depending legs are spaced laterally at each longitudinal edge of the adapter pad such that the depending legs are received in openings between laterally spaced shoulders of the bearing adapter. To avoid the build up of static electricity between the axle rotating within the roller bearing assembly and the railway freight car truck, it is desirable to have an electrical connection between the bearing adapter and the sideframe pedestal jaw.

Accordingly, it is an object of the present invention to provide an improved bearing adapter and pad assembly that provides an improved electrical connection between the bearing adapter and the sideframe pedestal jaw.

SUMMARY OF THE INVENTION

A railway freight car truck of the so-called three piece standard design, is comprised of two laterally spaced, sideframes usually of a unitary cast steel structure, and a laterally extending bolster, also usually of a unitary cast steel structure. The ends of the bolster are received and supported on spring groups that themselves are supported on the bottom section of a bolster opening in each sideframe.

The wheel axle assemblies themselves are received in openings, commonly referred to as pedestal jaw openings, at longitudinal ends of each sideframe. The wheel axle assemblies themselves extend laterally between the sideframes, and hence, also laterally between the two spaced railway tracks. For improved performance of the railway freight car truck, it is desirable to receive the roller bearing assemblies press fit on each axle end beneath a bearing adapter assembly. The bearing adapter assembly of the present invention is comprised of a cast steel, unitary bearing adapter. This bearing adapter includes lateral edges themselves having arcuate cutouts to be placed over the bearing assembly. The bearing adapter further comprises depending shoulders that extend from each longitudinal edge of the bearing adapter. The shoulders at each longitudinal edge of the bearing adapter themselves are laterally spaced to form an opening there between. It should be understood that the top section of such bearing adapter is generally rectangular in structure.

The improved bearing adapter pad in accordance with the present invention is comprised of an improved elastomer or polymer, usually a polyurethane. Such improved bearing adapter pad is usually formed in a casting operation, although recent improvements have allowed the improved adapter pad to also be formed in an injection molding operation. The bearing adapter pad itself is seen to be comprised of a generally rectangular main section, with two depending legs extending from each longitudinal edge thereof. The depending legs are spaced laterally on each longitudinal edge. Such depending legs are fit downwardly into the opening in the bearing adapter and abut the shoulders of the bearing adapter to provide lateral support for the adapter pad.

The bearing adapter pad inherently provides undesirable electrical insulation between the sideframe pedestal jaw and the bearing adapter that allows static electricity to build up between the sideframe and the bearing adapter. The elastomer pad in accordance with the present invention however includes a generally flat, generally rectangular main section, the elastomeric pad having a first opening in the main section, the first opening extending from a top surface of the main section, and a second opening in the main section, the second opening extending from a bottom surface of the main section, and a first electrical contact fitted into the first opening in the top surface of the main section, and a second electrical contact fitted into the second opening in the bottom surface of the main section, and a conductor extending from the first electrical contact to the second electrical contact.

With the proper relationship between cross section and hardness of the material of the elastomeric pad, a spring rate is designed into the elastomeric bearing adapter pad to assure electrical contact between the bearing adapter and the sideframe pedestal jaw.

DETAILED DESCRIPTION

Figure 1:
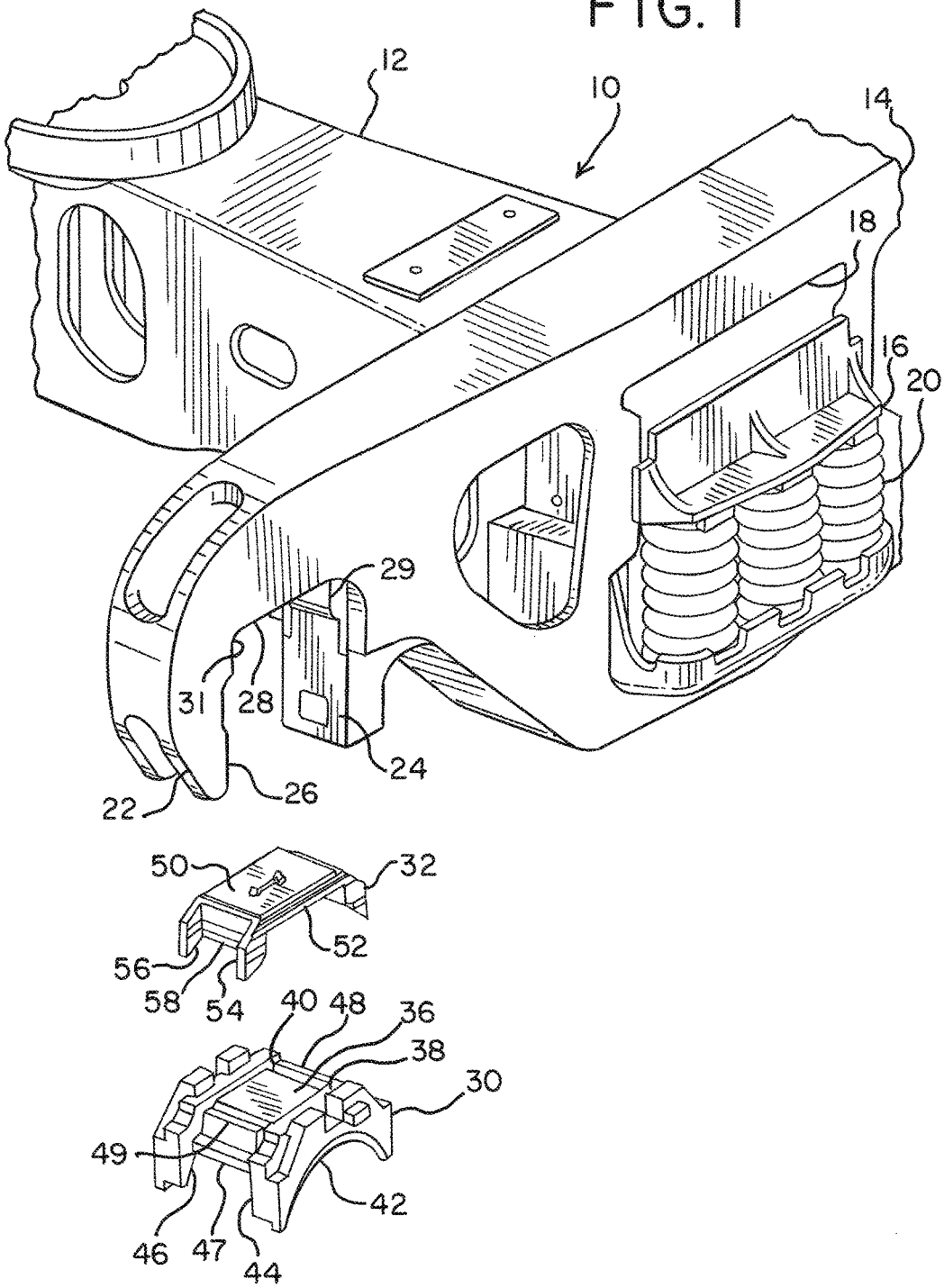
FIG. 1 is a partial perspective view of a sideframe and bolster, bearing adapter and elastomeric adapter pad in accordance with a first embodiment of the present invention.

Referring now to FIG. 1 of the drawings, the lateral end of each sideframe 14 is seen to be comprised of a downwardly extending pedestal jaw 22. The inside wall 26 of pedestal jaw 22, along with roof section 28 and vertical face 24 are seen to combine to form the pedestal jaw opening. At the interface between vertical face 24 and roof section 28, there is seen to be an inner thrust lug 29. Inner thrust lug 29 is seen to comprise an angled section that extends from an upper section of vertical face 24 to an inward section of roof section 28. Similarly, but not entirely seen in this perspective view of FIG. 1, outer thrust lug 31 is seen to comprise an angled section extending from an upper portion of inside wall 26 extending to an inner portion of roof section 28.

Bearing adapter 30, which is seen to be a generally rectangular unitary structure having four depending legs extending therefrom. Bearing adapter 30 is usually comprised of a unitary cast steel structure. Bearing adapter pad 32 is also seen to be a generally rectangular structure with four depending legs extending therefrom. Bearing adapter pad 32 is usually comprised of a cast or injection molded polymer or elastomer.

Bearing adapter 30 is seen to be comprised of a unitary, cast steel structure that is generally rectangular in shape. Bearing adapter 30 is comprised of a generally rectangular top section 36, which is seen to be generally flat. Two raised edge supports 38 are seen to extend upwardly from the lateral edges of bearing adapter 30, as are similar raised edge supports 40 from the opposite lateral edge of bearing adapter 30. The combined raised edge supports 38 and 40 form a receiving surface and pocket for bearing adapter pad 32. Bearing adapter 30 is also seen to comprise an arcuate opening 42 on each lower lateral edge; this arcuate opening 42 is adapted to seat against a bearing, which is not shown in this view. Bearing adapter 30 is also seen to comprise four depending shoulders, of which 44 and 46 are shown in this view. Depending shoulders 44 and 46 are seen to be laterally spaced, forming an opening for bearing adapter pad 32.

Bearing adapter pad 32 is usually comprised of a cast polymer or elastomeric material and is of unitary structure. It is also possible to construct adapter pad 32 with an injection method. Bearing adapter pad 32 is comprised of a generally rectangular and flat main section 50, with lateral edges, of which lateral edge 52 is shown. Four depending legs, of which depending leg 54 and 56 are shown in this view, are seen to extend downwardly, and form a thrust lug opening 58 there between. A similar thrust lug opening is formed on the other longitudinal edge of adapter pad 32. In assembling bearing adapter pad 32 onto the top of bearing adapter 30, it can be seen that depending legs 54 and 56 project downwardly and are supported laterally against depending shoulders 44 and 46, respectively, of bearing adapter 30.

Referring now to FIG. 1, the partial perspective view of the main components of a railway freight car truck are shown generally at 10. Such components include bolster 12, which is generally a cast steel unitary structure, that extends laterally between two sideframes 14. Sideframes 14 are also unitary cast steel structures. Sideframes 14 are seen to extend longitudinally and parallel with the railway tracks. Each sideframe 14 includes a bolster opening 18 through which end 16 of bolster 12 extends. End 16 of bolster 12 is supported on spring group 20, with damping devices known as friction shoes, which are not shown in this view.

Figure 2:
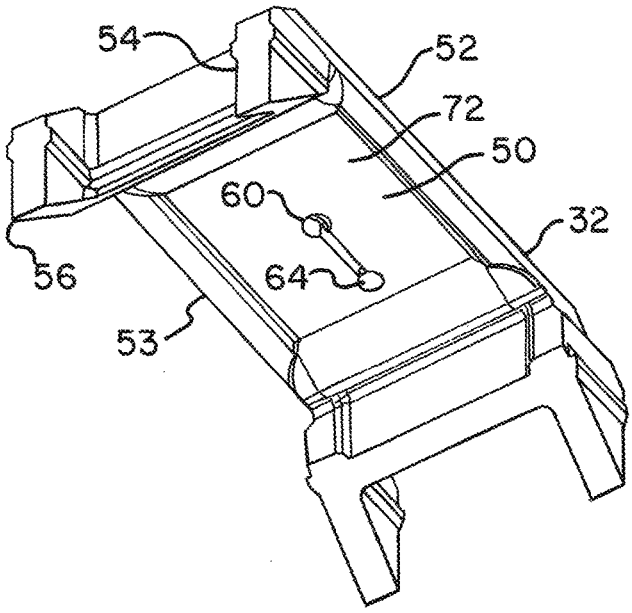
FIG. 2 is a bottom perspective view of an elastomeric adapter pad in accordance with a first embodiment of the present invention.
Figure 3:
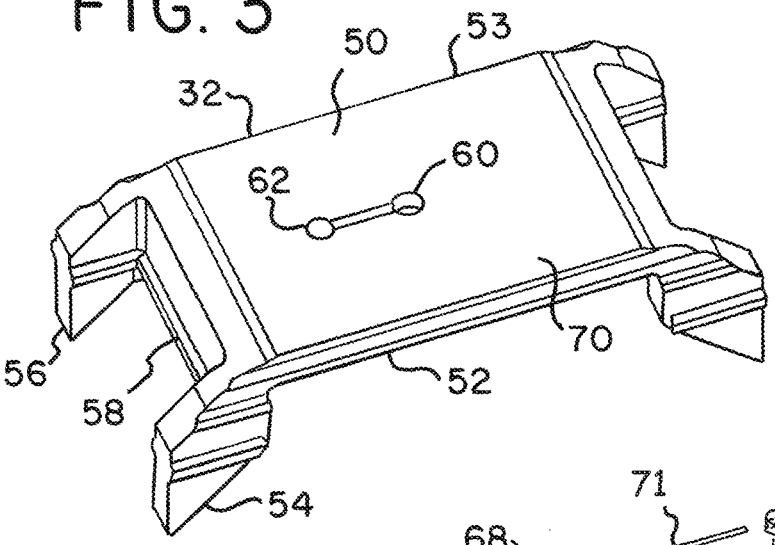
FIG. 3 is a top perspective view of an elastomeric adapter pad in accordance with a first embodiment of the present invention.
Figure 4:
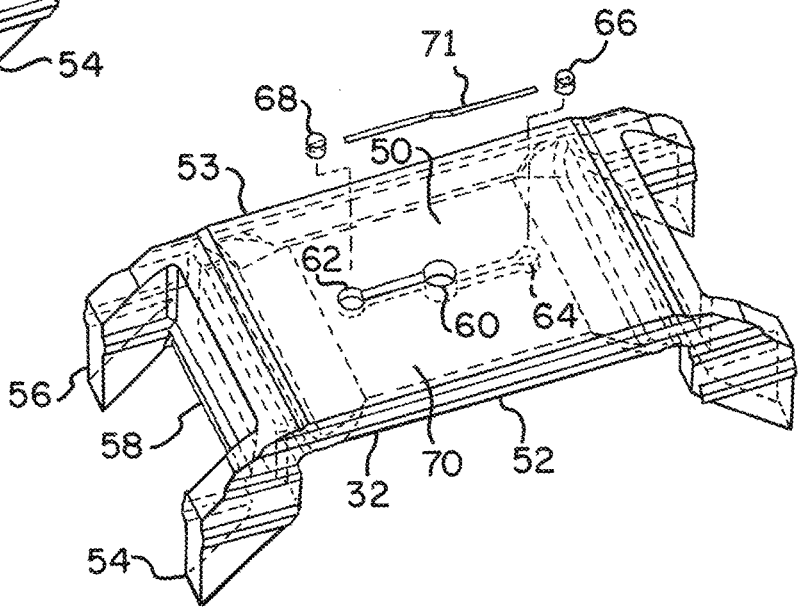
FIG. 4 is a top perspective view in partial cross section of an elastomeric adapter pad in accordance with a first embodiment of the present invention.

Referring now to FIGS. 2-4, a detailed view of bearing adapter pad 32 is provided. Bearing adapter pad 32 is seen to be comprised of a generally rectangular main section 50. Main section 50 includes lateral edges 52 and 53. Legs 54 and 56, extend downwardly from each longitudinal edge of adapter pad 32. Legs 54 and 56 are seen to be spaced laterally so as to form thrust lug opening 58 there between. Thrust lug opening 58 and its counterpart at the other longitudinal edge of adapter pad 32 is seen to receive one of inner thrust lug 29 or outer thrust lug 31, when adapter pad 32 is fit up into roof section 28 of sideframe pedestal jaw 22.

Bearing adapter pad 32 is also seen to comprise a centrally located opening 60 that extends through main section 50, extending through from top surface 70 of main section 50 through to bottom surface 72 of main section 50. Bearing adapter pad 32 is also seen to comprise a partial opening 62 that extends into top surface 70 of main section 50, but usually does not extend through to bottom surface 72 of main section 50. Bearing adapter pad 32 is also seen to comprise a partial opening 64 that extends into bottom surface 72 of main section 50, but usually does not extend through to top surface 70 of main section 50. An electrically conductive button or cap 68 is fitted into opening 62 in top surface 70 of main section 50. An electrically conductive button or cap 66 is fitted into opening 64 in bottom surface 72 of main section 50. An electrical conductor 71, usually comprised of an electrically conductive wire, connects electrically conductive button 68 to electrically conductive button 66 by passing through opening 60 in main section 50.

Adapter pad 32 is comprised of a cast elastomer of a durometer hardness between 90 A and 58 D. It should be understood that it is preferred to have adapter pad 32 formed in a casting operation to obtain the desired hardness ratings, but other forming operations are possible so long as the preferred hardness ratings of adapter pad 32 are provided. The spring compressive nature of bearing adapter pad 32 assures that electrical contact is maintained between bearing adapter 30 and sideframe 14 through electrically conductive button 66, conductor 71 and electrically conductive button 68.

What is claimed is:

1. An elastomeric pad for use in a railway car truck, the elastomeric pad configured to be mounted on top of an axle bearing adapter, the elastomeric pad comprising a generally flat, generally rectangular main section, the elastomeric pad further comprising a first partial opening in the main section, the first partial opening extending into a top surface of the main section, and a second partial opening in the main section, the second partial opening extending into from a bottom surface of the main section, wherein the first partial opening does not extend through to the bottom surface of the main section and the second partial opening does not extend through to the upper top surface of the main section, a first contact button fitted into the first partial opening and a second contact button fitted into the second partial opening, a conductor extending from the first contact button to the second contact button, and a through opening that extends through the main section of the elastomeric pad from the top surface of the main section to the bottom surface of the main section, wherein the conductor extends laterally through the through opening in the elastomeric pad, and wherein the first partial opening, the second partial opening, and the through opening are spaced apart from one another.

2. The elastomeric pad of claim 1 wherein the first contact button extends outwardly beyond the top surface of the main section of the elastomeric pad, and the second contact button extends outwardly beyond the bottom surface of the main section of the elastomeric pad.

3. The elastomeric pad of claim 1 wherein the first contact button contacts a pedestal area of a sideframe, and the second contact button contacts the axle bearing adapter.

4. The elastomeric pad of claim 1 wherein the conductor is an electrical conducting wire.

5. An elastomeric pad for use in a railway car truck, the elastomeric pad configured to be mounted on an axle bearing adapter, the elastomeric pad comprising a generally flat, generally rectangular main section, the elastomeric pad having a first partial opening in the main section, the first opening extending into a top surface of the main section, and a partial second opening in the main section, the second opening extending into a bottom surface of the main section, wherein the first partial opening does not extend through to the bottom surface of the main section and the second partial opening does not extend through to the upper top surface of the main section a first electrical contact fitted into the first partial opening and a second electrical contact fitted into the second partial opening, a conductor extending from the first electrical contact to the second electrical contact, and a through opening that extends through the main section of the elastomeric pad from the top surface of the main section to the bottom surface of the main section, wherein the conductor extends laterally through the through opening in the elastomeric pad, and wherein the first partial opening, the second partial opening, and the through opening are spaced apart from one another.

6. The elastomeric pad of claim 5 wherein the first electrical contact extends outwardly beyond the top surface of the main section of the elastomeric pad, and the second electrical contact extends outwardly beyond the bottom surface of the main section of the elastomeric pad.

7. The elastomeric pad of claim 5 wherein the elastomeric pad includes a through opening that extends through the main section of the elastomeric pad from the top surface of the main section to the bottom surface of the main section, and wherein the conductor extends through the through opening in the elastomeric pad.

8. The elastomeric pad of claim 5 wherein the first electrical contact contacts a pedestal area of a sideframe, and the second electrical contact contacts the axle bearing adapter.

9. The elastomeric pad of claim 5 wherein the conductor is an electrical conducting wire.

10. A railway car truck comprising two sideframes and a transversely mounted bolster, each sideframe having two pedestal jaw ends, an axle including an axle bearing received in each sideframe pedestal jaw end, an axle bearing fitted on an end of each axle, an axle bearing adapter received in each pedestal jaw end, each axle bearing received in the axle bearing adapter, a elastomeric bearing adapter pad mounted on top of the bearing adapter, the elastomeric pad comprising a generally flat, generally rectangular main section, the elastomeric pad further comprising a first partial opening extending into a top surface of the main section and a second partial opening extending into a bottom surface of the main section, wherein the first partial opening does not extend through to the bottom surface of the main section and the second partial opening does not extend through to the upper top surface of the main section a first contact button fitted into the first partial opening and a second contact button fitted into the second partial opening, a conductor extending from the first contact button to the second contact button, such that an electrical connection is provided between the bearing adapter and the axle bearing, and a through opening that extends through the main section of the elastomeric pad from the top surface of the main section to the bottom surface of the main section, wherein the conductor extends laterally through the through opening in the elastomeric pad, and wherein the first partial opening, the second partial opening, and the through opening are spaced apart from one another.

11. The elastomeric pad of claim 10 wherein the first electrical contact extends outwardly beyond the top surface of the main section of the elastomeric pad, and the second electrical contact extends outwardly beyond the bottom surface of the main section of the elastomeric pad.

12. The elastomeric pad of claim 10 wherein the elastomeric pad includes a through opening that extends through the main section of the elastomeric pad from the top surface of the main section to the bottom surface of the main section, and wherein the conductor extends through the through opening in the elastomeric pad.

13. The elastomeric pad of claim 10 wherein the first electrical contact contacts a pedestal area of a sideframe, and the second electrical contact contacts the axle bearing adapter.

* * * * *